United States Patent [19]

Kuo

[11] Patent Number: 4,919,556

[45] Date of Patent: Apr. 24, 1990

[54] WRITING IMPLEMENT HAVING SIMPLIFIED LEAD-FEEDING MECHANISM

[75] Inventor: Chun-Liang Kuo, Taipei, Taiwan

[73] Assignee: Pencell Co., Ltd., Taipei, Taiwan

[21] Appl. No.: 252,567

[22] Filed: Sep. 29, 1988

Related U.S. Application Data

[63] Continuation-in-part of Ser. No. 144,814, Jan. 15, 1988.

[51] Int. Cl.[5] ..... B43K 21/16

[52] U.S. Cl. ..... 401/57; 401/90; 401/92

[58] Field of Search ..... 401/57, 65, 90, 56, 401/89, 92

[56] References Cited

U.S. PATENT DOCUMENTS

| | | | |
|---|---|---|---|
| 480,188 | 8/1892 | Fornander | 401/57 X |
| 618,172 | 1/1899 | Goldsmith | 401/65 X |
| 1,151,016 | 8/1915 | Keeran | 401/87 |
| 1,378,174 | 5/1921 | Kaiser | 401/65 |
| 1,606,909 | 11/1926 | Wahl | 401/87 |
| 4,219,282 | 8/1980 | Kuo | 401/57 |
| 4,320,982 | 3/1982 | Kuo | 401/90 X |

FOREIGN PATENT DOCUMENTS

| | | | |
|---|---|---|---|
| 2121729 | 1/1984 | United Kingdom | 401/89 |

*Primary Examiner*—Steven A. Bratlie

*Attorney, Agent, or Firm*—Ladas & Parry

[57] ABSTRACT

A useful writing implement which comprises an outer casing and an inner tube inserted into the outer casing for storing a plurality of presharpened leads. The outer casing has an intregrally formed protrudent flexible elongated reduced neck portion for releasably engaging an upper enlarged portion of the inner tube. The neck portion is integrally formed with a lateral triangular flat protrustion for partially covering the upper enlarged portion of the inner tube for preventing the presharpened leads from slipping out of the inner tube. The outer casing is integrally formed with a dependent leg for insertion into a longitudianl slot provided at the lower end of the inner tube, the leg being integrally formed with an inward hook-shaped portion which will be forced to extend into the slot and slide on a longitudinal slide side wall provided at the upper end of the slot, to allow the leads to fall down when the inner tube is moved downward. The inner tube can be returned to its original position to cause a new lead to be pushed into a writing position.

5 Claims, 5 Drawing Sheets

A - A

WRITING IMPLEMENT HAVING SIMPLIFIED LEAD-FEEDING MECHANISM

This is a continuation-in-part of co-pending patent application No. 144,814, filed: Jan. 15, 1988.

BACKGROUND OF THE INVENTION

The present invention relates to a useful writing implement and, more particularly to an improved writing implement which utilizes an integral hook-shaped leg which is integrally formed on an outer casing, and laterally inserted into an inner tube through a longitudinal slot provided at the lower end of the inner tube in order to allow the expelling and feeding of presharpened pieces of pencil lead.

In my U.S. Pat. No. 4320982, a coil spring which has a lower end formed into a hook which slides along the slot formed between the clamping hales of the inner tube, is used for the expelling and feeding of presharpened pieces of pencil lead into the space between said two clamping halves. However, such a coil spring is integrally formed with an unsymmetrical hook-shaped end which can not be mass-produced, and is easily removed from the slot of the inner tube if the latter is slightly rotated by mistake, because said slot is very thin and said hook-shaped end is unsymmetrical. This will cause the entire writing implement to become unusable.

SUMMARY OF THE INVENTION

Accordingly, it is an object of the present invention to provide an improved compact construction in a presharpened pencil that comprises only two or three parts which can be easily mass-produced by means of molding.

It is a further object of this invention to provide, an outer casing having an integral inward hook-shaped leg for insertion into an inner tube for serving as a lead expelling means, and also having a protrudent flexible elongated reduced neck portion for engagement of the upper end of the inner tube for serving as a cap means.

According to this invention, the writing implement comprises an outer casing, an inner tube inserted into the outer casing, for storing a plurality of presharpened leads arranged in series. The upper end of the outer casing is integrally formed with a protrudent flexible elongated reduced neck portion for releasably engaging the upper enlarged portion of the inner tube. The neck portion is provided with a lateral flat protrusion for partially covering the upper open end of the inner tube. for preventing said presharpened leads from slipping out of the inner tube. The lower end of the outer casing is integrally formed with a dependent leg which is laterally inserted through a longitudinal slot provided at the lower end of the inner tube into the inner tube in order to allow the expelling and feeding of presharpened pencil leads.

This invention will become fully apparent from the detailed description with reference to the accompanying drawings which are given by way of illustration only, and thus are not limitative of this invention.

BRIEF DESCRIPTION OF THE DRAWING

As shown in FIGS. 1 and 2, the writing implement of the present invention mainly comprises an outer casing 1 and in inner tube 2 for storing a plurality of presharpened leads 3 arranged in series, which is inserted into the outer casing 1. The outer casing 1 is made of a plastic material by molding in a tube with an upper open end of receiving the inner tube therefrom and a lower frusto-conical end. The upper end of the outer casing is integrally formed with a protrudent flexible elongated reduced neck portion 11 having a recess 114 for releasably engaging the upper enlarged portion 21 of the inner tube 2. The neck portion 11 is integrally formed with a lateral triangular flat protrusion 11 for covering the upper open end of the inner tube for preventing the presharpened leads from slipping out of the inner tube. Hence, no additional cap means is required.

Figure 10:
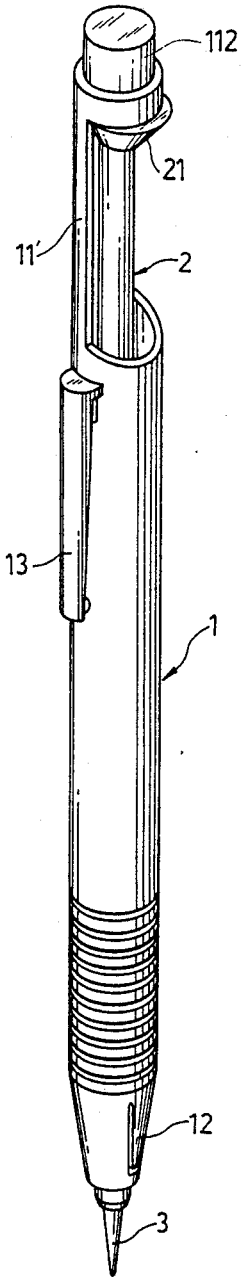
FIG. 10 is a perspective view of FIG. 7.
Figure 1:
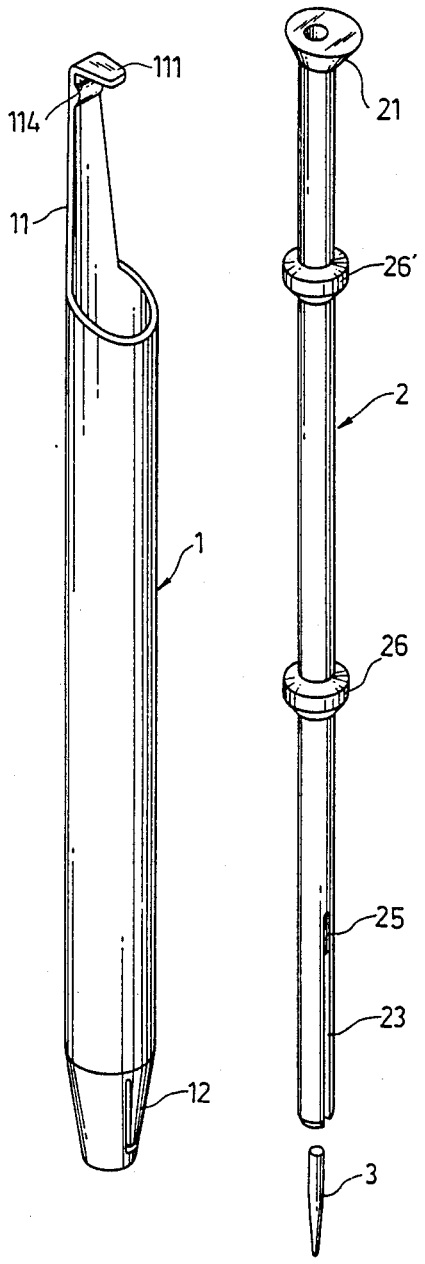
FIG. 1 is an exploded view of one embodiment of the writing implement according to the present invention.

The lower frusto-conical end of the outer casing 1 is integrally formed with a V-shaped groove that defines a dependent leg 12. This dependent leg is integrally formed with an inward hook-shaped portion 121 for lateral insertion into a longitudinal slot 23 provided at the lower end of the inner tube 2. Leg portion 121 acts to expel part of the lowermost presharpened pencil lead from the lower end of the inner tube when tube 2 moved from the FIG. 4 position. Hook - shaped leg portion 121 will extend into slot 23 due to the elasticity of the leg 12 material and its cantilever connection to casing 1.

Figure 11:
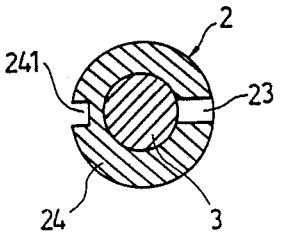
FIG. 11 is a cross section taken along lines A—A of FIG. 5.
Figure 12:
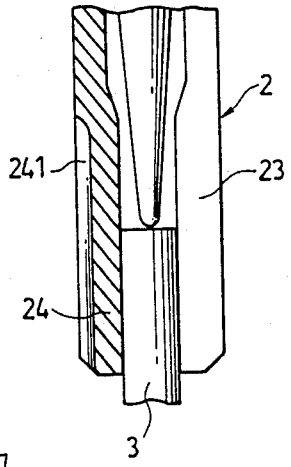
FIG. 12 is an enlarged view of circle B of FIG. 5.
Figure 13:
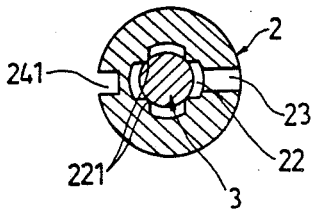
FIG. 13 is similar to FIG. 11, but showing the lower reduced tube channel which is additionally provided with a plurality of longitudinal small guide protrusions.
Figure 14:
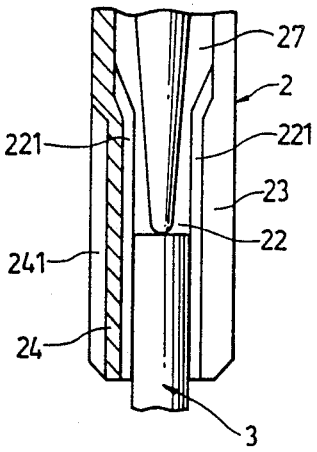
FIG. 14 is similar to FIG. 12, but showing the lower reduced tube channel which is additionally provided with a plurality of longitudinal small guide protrusions.

The inner tube 2 is also made of a plastic material. The interior of the inner tube forms a channel 27 for storing a plurality of pencil leads 3 arranged in series. The lowermost end of channel 27 is formed into a lower reduced tube channel 22 having a slightly smaller diameter for preventing the lowermost piece of pencil lead 3 from passing therethrough, so that the lead 3 is held within the inner tube 2. Through the uppermost open end of tube channel 27, new leads are fed into inner tube 2. As shown in FIG. 11 and 12, the lower outer peripheral wall 24 of the inner tube 2 is longitudinally integrally formed with a longitudinal groove 241 at a position confronting the longitudinal slot 23 for serving as a center of transverse bending of the lower outer peripheral wall 24 which has a C-shaped cross-section by forming a longitudinal slot 23, in order that the channel 22 can be slightly expanded by the pencil lead 3 when the latter passes therethrough. The upper closed end of slot 23 has a longitudinal slide groove wall 25 formed for sliding of the hook-shaped portion 121 of leg 12 thereon. The outer peripheral wall of the inner tube 2 is integrally formed with an upper annular protrusion 26' and a lower annular protrusion 26 for serving as the guides for sliding on the inner wall of the outer casing 1. As shown in FIGS. 13 and 14, the lower reduced tube channel 22 may be provided with a plurality of longitudinal small guide protrusions 221 on the inner wall thereof which are spaced in equal distance, for easily holding or guiding a pencil lead which is to be held or expelled from the inner tube.

Figure 2:
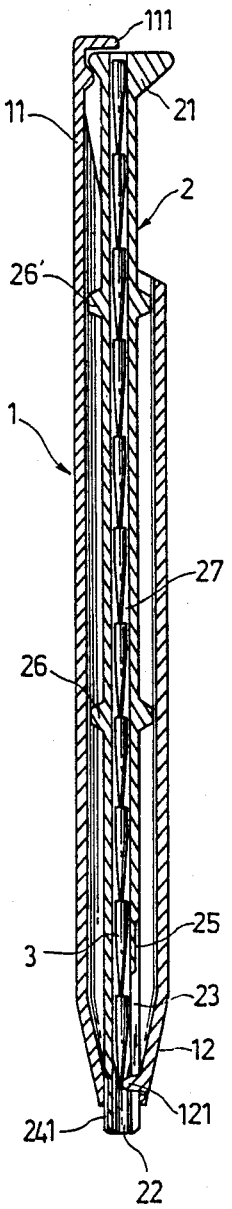
FIG. 2 is a longitudinal sectional view of the writing implement in FIG. 1.
Figure 3:
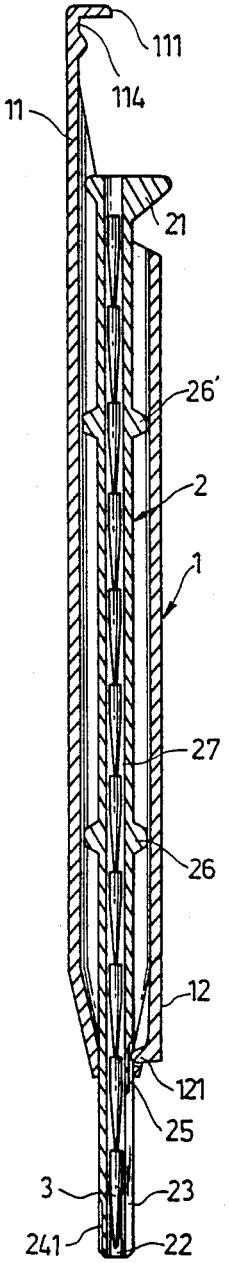
FIG. 3 is similar to Fog. 2, but showing the inner tube which has been moved to a lower position.
Figure 4:
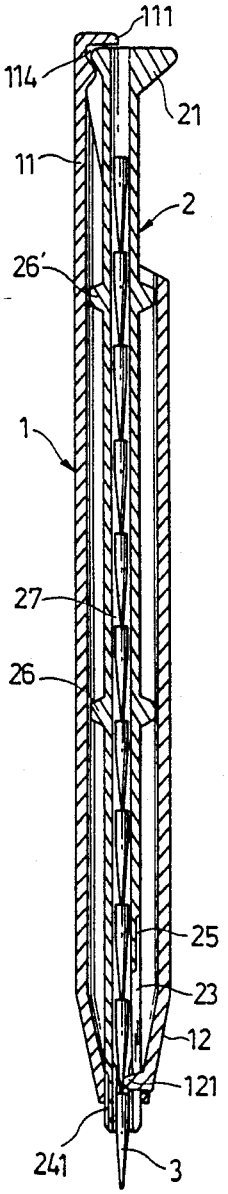
FIG. 4 is similar to FIG. 3, but showing the inner tube which has been moved to a upper position, and showing the lead which has been exposed.
Figure 5:
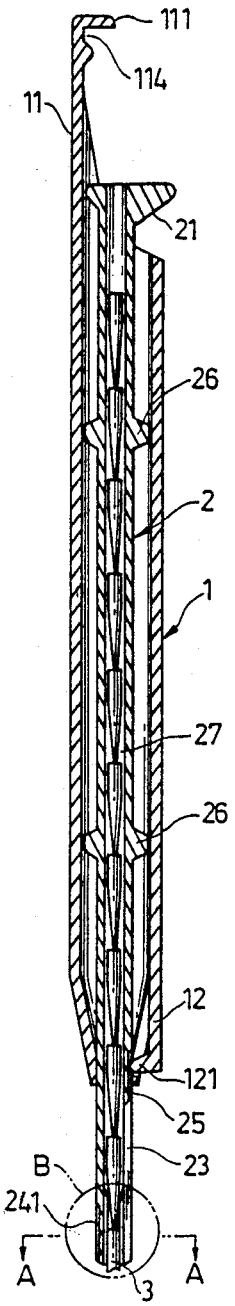
FIG. 5 is similar to FIG. 3 but showing the exposed lead which has been broken.
Figure 8:
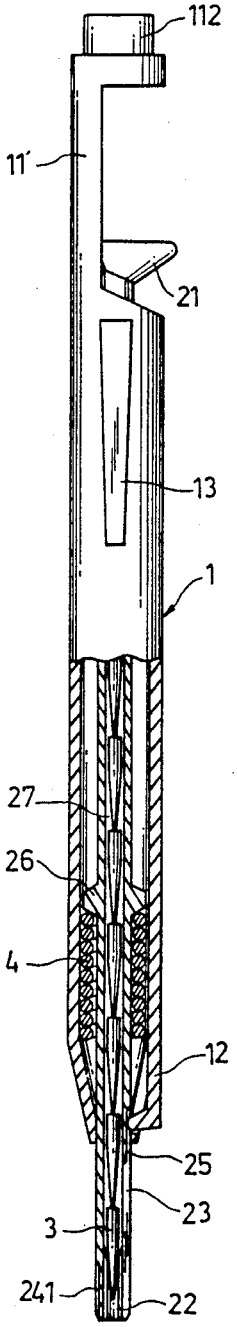
FIG. 8 is similar to FIG. 7 but showing the inner tube which has been moved to a lower position.

FIGS. 2 through 5 show the various stages involved in operating the present invention. The lead pieces are stored in a front-to-end fashion with the sharpened end of each piece being pointed towards the writing end of the present pencil. FIG. 2 shows the pencil before being used. When the user starts to pull inner tube 2 downwardly with his thumb by the upper enlarged portion 21 as shown in FIG. 3, the lowermost end of channel 27 is fully projected outside outer casing. When the slide groove wall 25 reaches the hook-shaped portion 121, the latter will be forced to extend into the slot 23 due to the elasticity of the material per se, and will slide on the slide groove wall 25 until the upper enlarged portion 21 reaches the end wall of the upper open and of the outer casing 1. At this time, the lowermost end piece of pencil lead in the inner tube 2 is no longer blocked by the hook-shaped portion 121 and is subsequently released. It falls automatically through the foremost end of tube channel 27 by its gravity. However, since the lowermost tube channel 22 is slightly smaller in diameter than lead 3, the lead is thus retained therein as shown in FIG. 3. The user then pushes the inner tube 2 upwardly with the same thumb until its upper enlarged portion 21 engages with the recess 114 of the outer casing 1. As a result, the lowermost end of channel 27 is withdrawn into the outer casing 1, and the hook-shaped portion is removed from the slide side wall 25 and inserted into the tube channel through slot 23. When the inner tube 2 is returned to its original upper position and its upper enlarged portion 21 is engaged with the neck portion 11 of the outer casing 1, the lowermost piece of lead will be completely pushed by the hook-shaped portion 121 into the lowermost end of the tube channel 22, and its sharpened end will be exposed for writing as shown in FIG. 4. Since the outside diameter of lead 3 is slightly larger than the inner diameter of the lowermost end of the tube channel 22 an extremely tight grip on the exposed lead can be obtained. When the lowermost piece of lead 3 has become blunt due to use and has to be replaced by second piece of lead 3, the above process may be repeated. As a result, the second piece of lead is pushed into the channel 22, and expels the blunt used lead completely out of inner tube 2 by the aid of the expansion of the slot 23.

Figure 6:
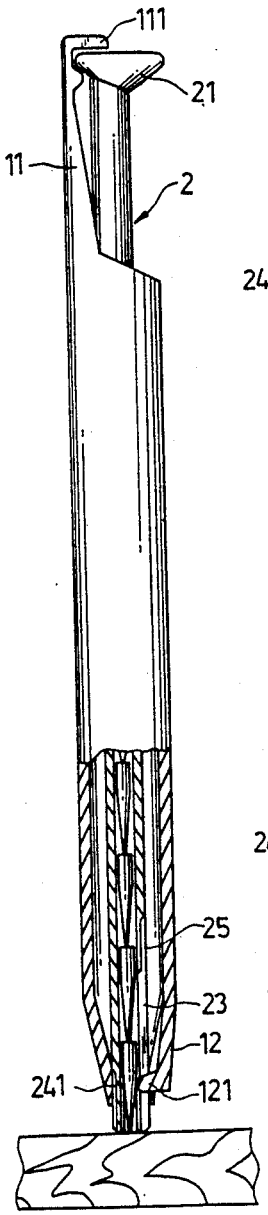
FIG. 6 is similar to FIG. 3, but showing the exposed lead which is pushed into the inner tube by means of the table top.

In the present invention, the pencil lead, used or not used, can be withdrawn into the inner tube by simply pushing the front end of the exposed pencil lead against any surface such as a table top as shown in FIG. 6.

Figure 7:
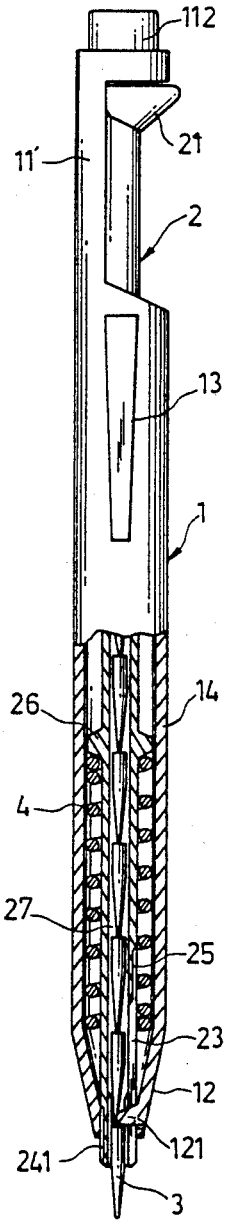
FIG. 7 is a longitudinal sectional view of the writing implement of the second embodiment according to the present invention.

Shown in FIG. 7 is a second embodiment of the present invention, it differs from the above embodiment in that first, an integral tube extension 11' having a lateral opening 14 is used instead of the neck portion 11; second, a coil spring 4 is further provided between the annular protrusion 26 which is integrally formed on the inner tube 2 and the upper inner periphery of the lower frusto-conical end of the outer casing 1, for forcing the inner tube back to its original position without the aid of thumb after the inner tube has been moved to a lower position; third, an eraser block 112 is provided on the upper end of the integral tube extension 11', and the outer casing 1 is further integrally formed with a clip member 13.

Figure 9:
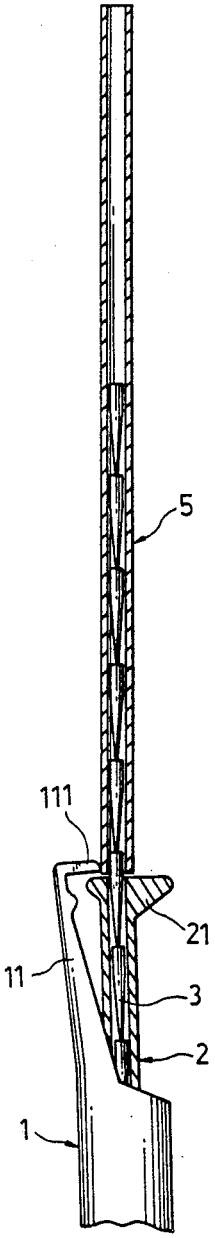
FIG. 9 is a diagram of a plastic spare tube according to the present invention.

FIG. 9 shows an embodiment of a plastic spare tube 5 filled with a plurality of presharpened pencil leads. By slightly laterally moving the lateral flat protrusion 111 and putting the opened end of spare tube 5 onto the upper opening of the inner tube 2, the lead pieces will fall into the inner tube one by one so as to fill it completely. However, should the user prefer, the lead may be inserted individually into the inner tube 2 without using plastic spare tube 5.

The leads used in the present invention will not be limited to pencil leads. Other working implements which can utilize the construction of the present invention and, therefore, are within the scope thereof including colored pencils, crayons, paraffin pencils, and the like.

I claim:

1. A writing implement comprising an elongated annular outer casing (1), an inner tube (2) slidably mounted within said outer casing, and a plurality of pre-sharpened leads (3) stacked in axial alignment within said tube;

said outer casing comprising an annular molded plastic member having first and second end sections; said first end section being configured as a frusto-conical head; a V-shaped slot extending through the wall of said head to form an axially elongated resilient leg (12) integral with the head; said resilient leg having a cantilever connection with the associated head wall, and a free end spaced a short distance axially from the end edge of the head; and a hook section (121) extending generally radially inwardly from the free end of said leg, said hook section being integral with the leg;

said resilient leg having a normal unstressed position wherein its outer side surface lies in the outer surface plane of the frusto-conical head, with the hook section extending radially inwardly to the casing axis; said reilient leg having a stressed position wherein its outer side surface projects outwardly beyond the outer surface plane of the frusto-conical head;

said inner tube having a led-gripper end section adapted to move between a retracted position extending a relatively short distance out of said frusco-conical head, and an extended position projecting a relatively great distance beyond said frusto-conical head; a relatively long axial slot (23) formed in said tube end section; and a relatively short axial groove (24) formed in the outer surface of said tube end section at a point diammetrically opposite said axial slot; said groove having sufficient depth as to permit the semi-circular wall sections formed by said groove to resiliently deflect for gripment of a sharpened lead projecting beyond the tube end section; said tube being oriented within said casing so that the hook section of the resilient leg extends into the slot when said tube lead-gripper end section is in its retracted position whereby said hook section is located between the projecting and the remaining leads within the tube.

2. The writing implement of claim 1, wherein said second end section of the outer casing is cut away around a substantial portion of the casing circumference so as to form an axially elongated neck section (11); said tube having second end section thereof communicating with said cut-away section, whereby a person's thumb can be inserted into the cut-away section to exert manual operating pressure on the tube.

3. The writing implement of claim 2, and further comprising a radial protrusion (111) extending from said elongated neck section across the casing axis to prevent presharpened leads from escaping from the tube.

4. The writing implement of claim 3, wherein said elongated neck section is flexible so that it can be drawn away from the casing axis to enable presharpened leads to be inserted into the tube through the space normally occupied by the radial protrusion.

5. The writing implement of claim 3, and further comprising an enlarged flange (21) formed on the second end section of said tube; and an internal recess (14) formed within said elongated neck section for releasable detentive engagement with said enlarged flange when the tube is in its retracted position.

* * * * *